US005868130A

United States Patent [19]

Stier

[11] Patent Number: 5,868,130

[45] Date of Patent: Feb. 9, 1999

[54] UNDERWATER EMERGENCY BREATHING DEVICE

[75] Inventor: Barry Stier, Boca Raton, Fla.

[73] Assignee: Sea Turtle Scuba, Inc., Boca Raton, Fla.

[21] Appl. No.: 963,785

[22] Filed: Nov. 4, 1997

[51] Int. Cl.[6] ..... A62B 18/10

[52] U.S. Cl. ..... 128/201.28; 128/204.26; 128/205.24; 128/206.29

[58] Field of Search ..... 128/201.28, 204.26, 128/205.24, 206.29; 251/364

[56] References Cited

U.S. PATENT DOCUMENTS

| | | | |
|---|---|---|---|
| 439,093 | 10/1890 | Barlan | 128/205.24 |
| 769,755 | 9/1904 | Madsen . | |
| 1,331,601 | 2/1920 | Watanabe | 128/206.29 |
| 2,839,053 | 6/1958 | Lorenz | 128/142 |
| 2,874,692 | 2/1959 | Galeazzi | 128/142 |
| 3,238,943 | 3/1966 | Holley | 128/142 |
| 4,111,342 | 9/1978 | Kirby | 137/557 |
| 4,338,884 | 7/1982 | Atchley et al. | 119/72.5 |
| 4,365,628 | 12/1982 | Hodel | 128/205.12 |
| 4,637,387 | 1/1987 | Hall | 128/205.24 |
| 4,840,199 | 6/1989 | Brunt, Jr. | 137/883 |
| 4,915,354 | 4/1990 | Sims, Jr. et al. | 251/364 |
| 5,209,226 | 5/1993 | Goodley | 128/205.25 |
| 5,255,687 | 10/1993 | McKenna | 128/730 |
| 5,379,762 | 1/1995 | Kobayashi | 128/201.28 |

*Primary Examiner*—Aaron J. Lewis
*Attorney, Agent, or Firm*—Quarles & Brady LLP

[57] ABSTRACT

An emergency breathing device comprises: a mouthpiece; a valve body having one end receiving a hose coupling and one end receiving the mouthpiece, the valve body having a valve opening adjacent the mouthpiece end; a resilient seal interiorly of the valve opening; a valve having a seal engaging surface, gas pressure in the hose urging the valve into a sealing engagement with the seal; and, a valve actuator extending through the valve opening and substantially through the mouthpiece. Inward squeezing pressure exerted on the valve actuator through the mouthpiece opens the sealing engagement, allowing a breathable gas to flow from the hose into the mouthpiece. The device can be particularly adapted to be responsive to biting pressure while held in a diver's mouth and to operate right side up and upside down.

21 Claims, 4 Drawing Sheets

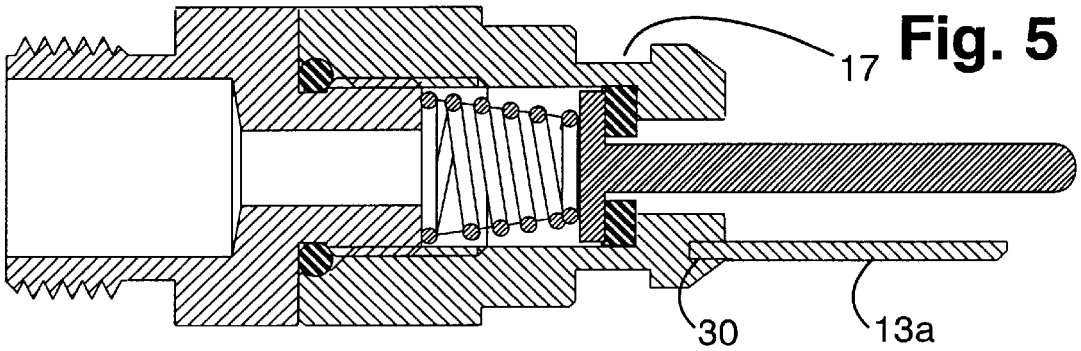
Fig. 5
Fig. 6
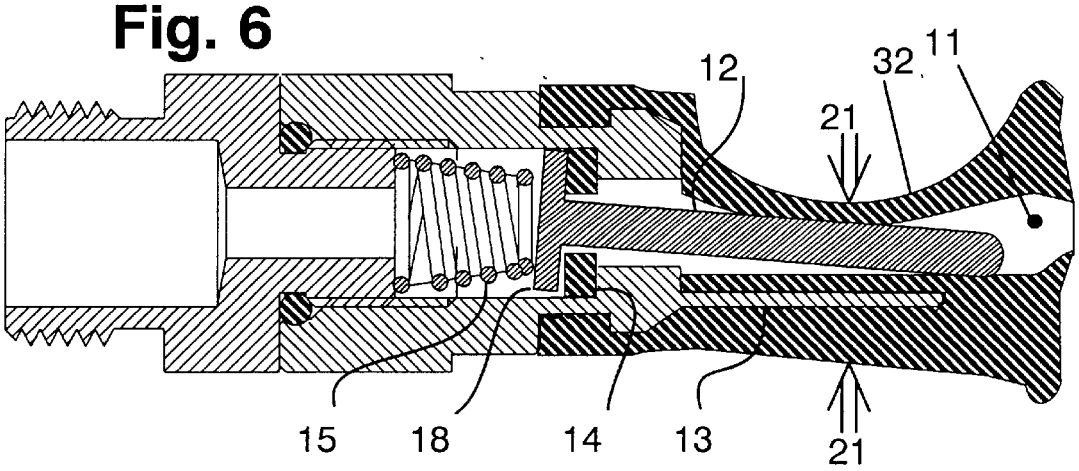
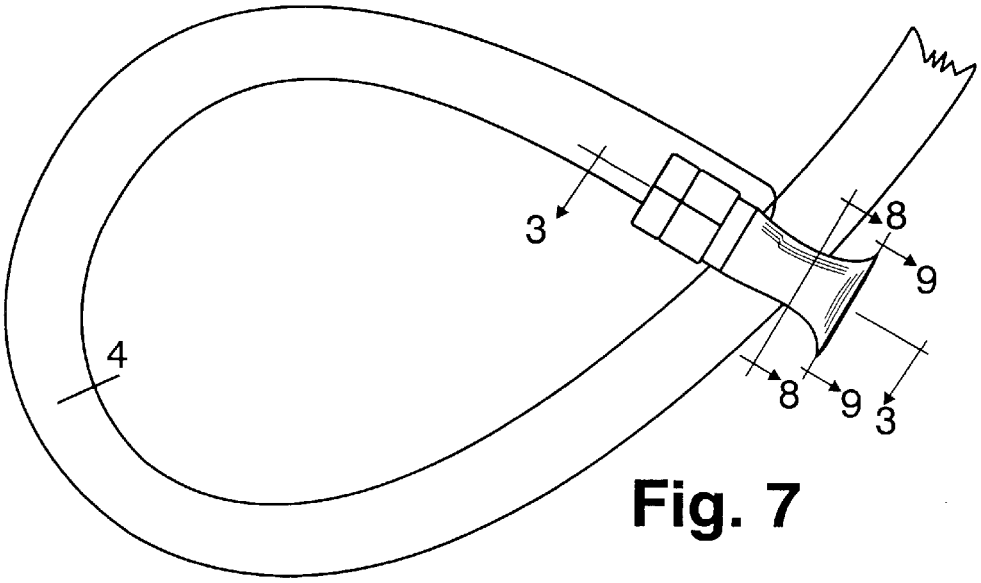
Fig. 7

UNDERWATER EMERGENCY BREATHING DEVICE

BACKGROUND OF THE INVENTION

1. Field of the Invention

This invention relates in general to the field of self contained underwater breathing apparatus (SCUBA), and in particular, to an improved secondary breathing device which can be attached to a SCUBA tank for the purpose of allowing a second diver to safely access the breathable gas, for example air, from the supply of the SCUBA tank in an emergency situation.

2. Description of Related Art

Most SCUBA divers will only dive in pairs, for safety reasons. In an emergency, one diver can often save the life of the other. One of the most obvious and dangerous emergencies is when one of the divers unexpectedly runs out of air. Unless the divers are very close to the surface, the only solution to the emergency is for both divers to share the air of the diver who still has a useable supply. This has been accomplished in the past by the use of various devices and or procedures. The actual time involved in the process is usually very short, being only long enough for the two divers to safely ascend to the surface.

All present systems for supplying a companion diver with air in an emergency are in some way dependant upon the breathing device used by SCUBA divers called a regulator. Most modern regulators consist of two valves connected by a hose, which attaches to a tank of highly compressed air carried by each diver.

One valve, called the first stage, is connected directly to a valve on the tank of air. Its function is to reduce the high pressure of the air coming out of the tank to a safer low pressure. high pressure of the air coming out of the tank to a safer low pressure.

The second valve, at the other end of the hose, is called the second stage. It has a mouthpiece and is held in the mouth of the diver. Its purpose is to deliver the low pressure air in the hose to the mouth of the diver, at ambient pressure, as the diver requires, through normal breathing processes.

One method of sharing air in an emergency is commonly called buddy breathing. It is accomplished by the diver, who is out of air, approaching the other diver, and through the use of hand signals, indicating that he needs air. The two divers then take turns breathing out of the second stage belonging to the diver who still has air. One important problem involved in buddy breathing is its extreme danger if one of the divers panics because of the fear of not getting enough air to breath. This can cause a fight for the single mouthpiece and lead to the death of the weaker of the two divers, or in some cases, both divers. Buddy breathing requires an uncomfortable swimming position, with the two divers facing each other and each with one hand gripping the common second stage. The air loss inherent in this method, as the divers pass the second stage back and forth, is even more dangerous because if one diver has run out of air, it is probable that the other diver is also carrying a tank that is nearing depletion. Yet another danger is that one diver must hold his or her breath while the other diver is breathing. If a diver holds his or her breath while ascending, the resultant lessening of ambient pressure could cause serious internal injury or even death. Finally, sharing a common mouthpiece between divers is also unsanitary. If one diver is aware the other diver has certain medical conditions, that diver may be unwilling to buddy breathe in the first instance. At the same time, a diver aware of his or her own medical condition may be reluctant to seek buddy breathing assistance. Fear of contamination or infection may not seem reasonable to anticipate at first consideration, but it must be remembered that running out of air underwater is as panic prone a situation as can be imagined.

Another, and presently popular method, is the use of a device commonly called an octopus. The octopus is a regulator which has two second stages attached to the first stage instead of just one. Both are identical in every aspect except that the one attached for the emergency use of the dive partner is usually attached to a slightly longer hose to allow the two divers to swim more comfortably side by side while ascending. This is a much safer method. The octopus protects the diver who has run out of air by giving him an additional source of air. The octopus also protects the diver who is carrying it by reducing the possibility that the other diver will panic and attempt to forcibly take the diver's air source out of the diver's mouth. One problem with the octopus is that it is expensive. While the basic regulator, consisting of a first and second stage, is an absolute necessity for SCUBA diving, the added second stage is not. Many divers with a limited budget do not purchase and use the additional second stage on their regulator, hoping that an emergency will not arise, or hoping to be able to handle the emergency by using the buddy breathing method.

Since the second stage device is asymmetrical, with one end attached to a hose, during an emergency in which seconds count and panic is common, it is possible for the diver who needs the air to fumble away precious seconds trying to get the proper part of the second stage in his mouth. During night dives and under cloudy water conditions, it is not always possible to even look at the second stage before trying to use it. It is also dangerous in the situation in which the diver needing the air has already exhaled. The dead space of the extra second stage is large, and is filled with water as it hangs on the extra hose. If the diver without air tries to inhale from a normal second stage, he or she will get a mouthful of water before getting any air, possibly causing choking. The only way to avoid this problem is to press a purge button on the second stage which will blow the water out of the regulator before it is used. This means that the diver experiencing the emergency must have the functional use of at least one hand in order to use the device. More importantly, the diver must also remember to perform this action while the diver is in this emergency situation. Such emergencies do not usually occur, and too many divers do not practice enough.

In the event the diver in trouble is unconscious, or otherwise incapacitated, it may be very difficult or impossible for the rescuing diver to force the large mouthpiece of a normal regulator second stage into the mouth of the diver needing it.

Another problem with the octopus is that the regulator second stage that is hanging on the end of that extra hose for emergency use is left dangling freely from the equipment of the diver. It must be carried that way so the diver who runs cut of air can quickly grab it for emergency use. Unfortunately, the octopus has a shape and size, as it hangs freely, which makes the octopus prone to getting caught in crevices and tangled on submerged fishing lines or any number of other underwater hazards. The octopus therefore poses a danger to the diver to whom it is attached, even absent any emergency. Another problem, related to hanging freely, is that the second mouthpiece is subject to being clogged with sand or mud from the bottom during the course of the dive, without either diver being aware of the octopus being thereby rendered inoperable for any possible emergency. Finally, the octopus will cease to function over time even absent any of the problems noted above, unless it is be carefully maintained, washed after each dive and periodically serviced by trained personnel. Otherwise it will not function.

The kinds of problems described above in connection with SCUBA gear are also problems faces by firemen, and other rescue workers, who upon entering mines, tunnels and similar hostile environments, must also carry self contained breathing apparatus. Rescue breathing equipment is subject to the same dangers as those for SCUBA divers.

Accordingly, there is a long felt need for an auxiliary breathing device which can be safely and conveniently used with SCUBA gear and other rescue breathing apparatus in an emergency and without the problems and additional risks described above.

SUMMARY OF THE INVENTION

An underwater emergency breathing device in accordance with the inventive arrangements disclosed and taught herein satisfies the long felt need of the prior art for an auxiliary breathing device which can be safely and conveniently used with SCUBA gear and other rescue breathing apparatus in an emergency and without the problems and additional risks presented by prior art devices.

Reference is made herein to air as well as to breathable gas. Those skilled in the art understand that divers sometimes use compressed air and sometimes use various combinations of oxygen and other gases compressed together, depending upon operating diving depths. The inventive arrangements taught herein are not limited to the nature or composition of any particular breathable gas or mixture.

The underwater emergency breathing device in accordance with the inventive arrangements overcomes the problems and disadvantages of the various ways prior art methods and apparatus for sharing air in an emergency situation, by providing a device which replaces the extra second stage that is now used on the octopus regulator. The new underwater emergency breathing device advantageously avoids becoming entangled with underwater objects because the underwater emergency breathing device is completely smooth with no internal corners or edges and only two small, sloped soft sided projections. The underwater emergency breathing device advantageously cannot become inoperable by filling with sand or mud if it is dragged on the bottom. Advantageously, the underwater emergency breathing device has an extremely small interior chamber dead space, and accordingly, contains so little water before use as to be of no consequence. The underwater emergency breathing device advantageously can be placed in the mouth in zero visibility and will automatically position itself as the mouth accepts it. The underwater emergency breathing device advantageously requires only a slight biting movement with the mouth to release a constant stream of air into the mouth of the diver. As a consequence of the small, streamlined mouthpiece, the device can advantageously be easily slipped into the mouth of an unconscious or incapacitated diver. As a consequence of the ease of use, the rescuing diver can easily force air into the mouth of an unconscious diver merely by pressing up on the diver's chin when the device is in place. The underwater emergency breathing device advantageously needs no special maintenance or servicing, and in fact, can be opened by a diver with common wrenches for inspection and cleaning. Finally, the underwater emergency breathing device is advantageously so inexpensive to produce as to totally eliminate the problem of the expense of this necessary safety accessory.

The underwater emergency breathing device has the added utility of being useable as an underwater tool by the diver. The underwater emergency breathing device can be inserted into the open bottom of any lifting device and squeezed with the fingers, filling the lifting device with air. The underwater emergency breathing device can also be used to deliver a stream of air to blow sand away from objects on the bottom. This is a common need of persons doing underwater archeological work or examining seashells or looking at artifacts and other objects that should not be touched.

The special features of the present invention are as follows:

An air delivery device comprised of a mouthpiece preferably made of silicon rubber which is attached to the downstream side of a stem valve (or tilt valve) and mounted on the downstream end of a hose connected to the low pressure air supply of a standard SCUBA or similar air regulator.

The device is designed in such a way so as to keep the valve in a normally closed position, but to deflect the stem of the valve when the mouthpiece is squeezed by the mouth or fingers of the diver, regardless if the mouthpiece is upside down or right side up, opening the air passage of the valve and allowing air to pass the deflected stem and through a channel running the length of the mouthpiece and out the opening located in the downstream end of the mouthpiece.

The device is small in size and smooth sided to prevent its catching on objects.

It has only one moving part, eliminating the need for special servicing or care and making the chance of malfunction almost non-existent.

It has an internal space so small that the amount of water contained therein will be of no practical consideration at the time of using the device for emergency breathing.

An emergency breathing device in accordance with an inventive arrangement comprises: a resilient mouthpiece; a valve body having a through passage connecting opposite ends of the valve body respectively adapted for receiving a hose coupling and the mouthpiece, the valve body having a valve opening adjacent the mouthpiece end; a resilient seal seated on an axially interior side of the valve opening; a valve having a seal engaging surface, gas pressure in the hose urging the valve into a sealing engagement with the seal; and, a valve actuator disposed in the mouthpiece and engaging the valve, whereby inward squeezing pressure from opposite sides exerted on the valve actuator through the mouthpiece opens the sealing engagement, allowing a breathable gas to flow from the hose into the mouthpiece, and termination of the inward squeezing pressure enables the gas pressure to close the sealing engagement and stop the flow of the breathable gas.

In a presently preferred embodiment, the valve actuator advantageously comprises a valve stem extending from the valve, through the valve opening and substantially through the mouthpiece the valve stem being substantially axially aligned in the valve opening and in the mouthpiece during the sealing engagement. The valve body further advantageously comprises a substantially rigid member projecting from the mouthpiece end of the valve body into the mouth piece, substantially parallel to and offset from the valve stem when the valve stem is in the substantially axial alignment, whereby the valve stem resists translating off axis responsive to the exerted pressure, and instead reliably tilts off axis responsive to the exerted pressure. The rigid member can be embedded in a wall of the mouthpiece.

The device can advantageously further comprise resilient means for urging the valve into the sealing engagement with the valve seat absent the air pressure in the hose, the valve stem being substantially axially aligned in the valve opening and in the mouthpiece during the sealing engagement.

The mouthpiece can have a substantially oval cross section with a major axis and a minor axis, the mouthpiece having sides at opposite ends of the major axis and a top and a bottom respectively at opposite sides of the minor axis. The valve body and the mouthpiece are, advantageously, not substantially larger in any outer diameter than the hose, whereby emergency breathing can be provided through small openings. Advantageously, the valve actuator reliably opens the valve responsive to the exerted pressure when the mouthpiece is oriented right side up in a mouth and when the mouthpiece is oriented upside down in the mouth.

The mouthpiece can advantageously comprise at least one longitudinal channel for safely venting excess gas pressure and water from a mouth in which the device is inserted.

The device can advantageously further comprise means in the mouthpiece for controlling deformation of the mouthpiece to ensure reliable opening of the sealing engagement when the pressure is exerted equally on the valve actuator through the mouthpiece from opposite directions. The deformation controlling means can advantageously be embedded in a wall of the mouthpiece and can rigidly project from the valve body.

A SCUBA gear assembly in accordance with another inventive arrangement comprises: a tank for a compressed breathable gas; an octopus regulator for supplying the breathable gas from the tank; a first hose connected to the octopus regulator; a first secondary stage regulator and mouthpiece connected to the octopus regulator by the first hose; a second hose connected to the octopus regulator; a second secondary stage regulator and mouthpiece adapted for emergency breathing; a valve body in the second secondary stage regulator having a through passage between opposite ends thereof, the valve body having at one of the ends a hose coupling connected to the second hose and having the mouthpiece at the other of the ends; a resilient seal seated on an axially interior side of the valve opening; a valve having a seal engaging surface, gas pressure in the hose urging the valve into a sealing engagement with the seal; and, a valve actuator disposed in the mouthpiece and engaging the valve, whereby inward squeezing pressure from opposite sides exerted on the valve actuator through the mouthpiece opens the sealing engagement, allowing a breathable gas to flow from the hose into the mouthpiece, and termination of the inward squeezing pressure enables the gas pressure to close the sealing engagement and stop the flow of the breathable gas.

The second secondary stage regulator and mouthpiece can advantageously comprise means for controlling deformation of the mouthpiece, for example embedded therein, to ensure reliable opening of the sealing engagement when the pressure is exerted equally on the valve actuator through the mouthpiece from opposite directions.

The mouthpiece can have a substantially oval cross section with a major axis and a minor axis, the mouthpiece having sides at opposite ends of the major axis and a top and a bottom respectively at opposite sides of the minor axis. Advantageously, the valve actuator reliably opens the valve responsive to the exerted pressure when the mouthpiece is oriented right side up in a mouth and when the mouthpiece is oriented upside down in the mouth.

The valve body and the mouthpiece are, advantageously, not substantially larger in any outer diameter than the hose, whereby emergency breathing can be provided through small openings.

The second secondary stage regulator and mouthpiece can advantageously further comprise resilient means for urging the valve into a sealing engagement with the valve absent the gas pressure.

The mouthpiece can advantageously comprise at least one longitudinal channel for safely venting excess gas pressure and water from a mouth in which the mouthpiece is inserted.

BRIEF DESCRIPTION OF THE DRAWINGS

FIG. 5 is a section view corresponding to FIG. 3, with the mouthpiece removed, and showing an alternative embodiment.

FIG. 6 is a section view corresponding to FIG. 3, with the valve tilted into an open position.

FIG. 7 illustrates the underwater emergency breathing device connected to a low pressure hose.

DETAILED DESCRIPTION OF THE PREFERRED EMBODIMENTS

Figure 1:
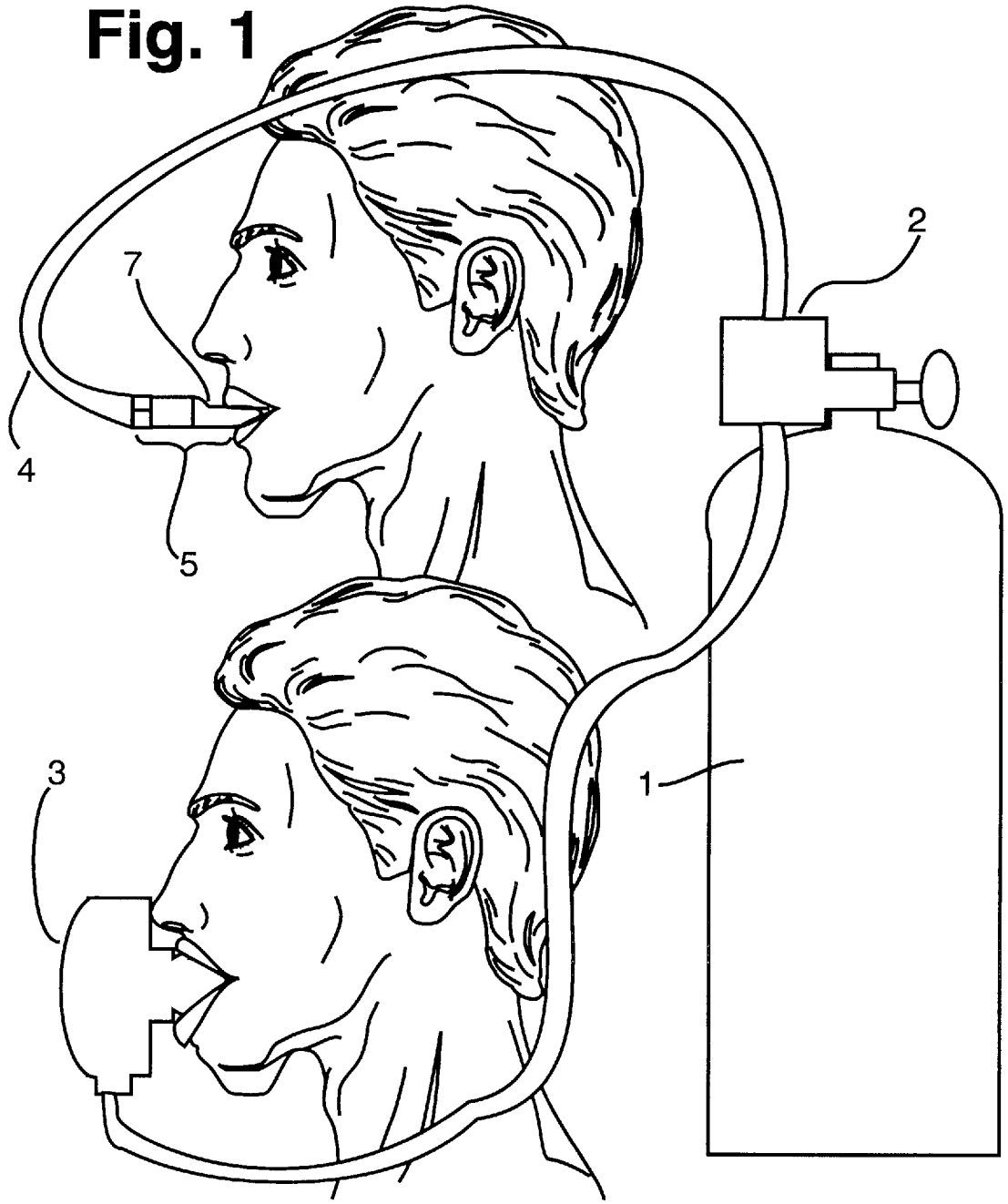
FIG. 1 pictorially illustrates a first diver breathing through a normal second stage of an octopus regulator and a companion diver buddy breathing with the underwater emergency breathing device in accordance with the inventive arrangements, also attached to the octopus regulator.

FIG. 1 is a pictorial representation of two divers engaged in emergency buddy breathing. The lower diver uses a standard secondary stage regulator 3, including a mouthpiece, which is connected to an octopus primary stage regulator 2 on a tank 1 of compressed air by a low pressure hose. The tank 1, octopus regulator 2, secondary stage regulator 3 and the low pressure hose are as found in standard SCUBA gear, as is a second low pressure hose 4 also connected to the octopus regulator 2, and need not be described more fully herein. All the other equipment normally worn by the divers, such as mask, snorkel and the like, has been omitted for the sake of simplicity.

The tank 1, which is normally filled with air compressed to a pressure of about 2,400 to 3,300 pounds per square inch (psi) prior to the dive, will have somewhat less pressure because the pressure in the tank 1 is reduced as the air supply is depleted by the diver during the dive. The first stage 2 of the regulator reduces the pressure of the air entering the low pressure hose 4 to about 120–140 psi over ambient pressure. The hose 4 is generally designed to handle up to about 200 psi and is commonly available from many commercial sources. The first stage of most regulators generally has two or more low pressure ports to which low pressure hoses may be attached.

An underwater emergency breathing device 5 in accordance with the inventive arrangements is connected to the end of hose 4. The device 5 comprises a novel secondary stage regulator 6 and a novel mouthpiece 7, which together form a novel secondary stage regulator for emergency breathing.

Figure 2:
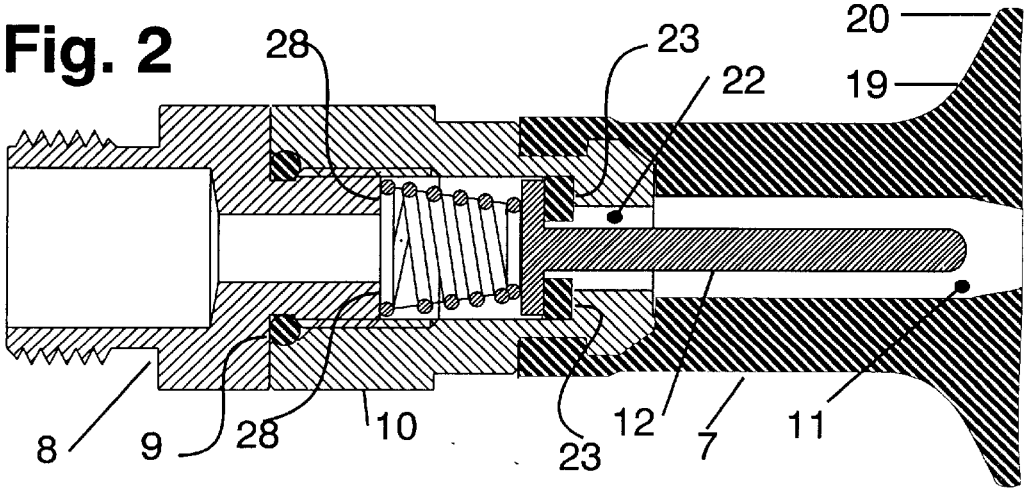
FIG. 2 is a section taken along the line 2—2 in FIG. 4, with the valve in a closed position.
Figure 4:
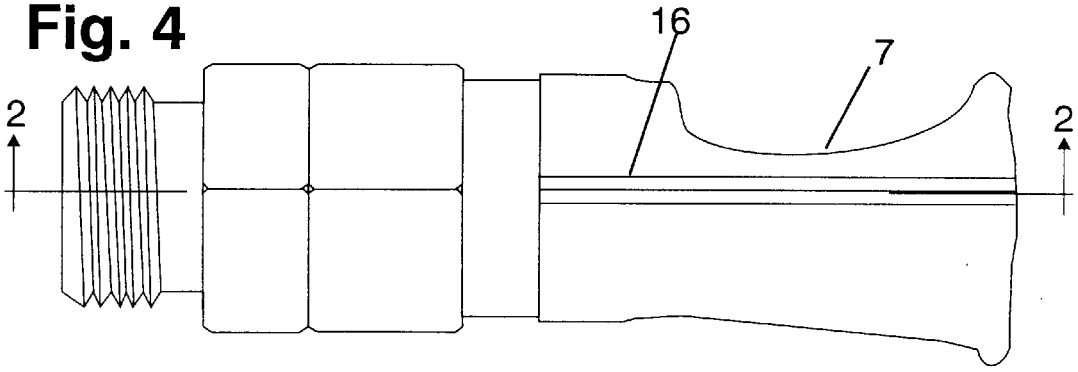
FIG. 4 shows a side view elevation.

FIG. 2 is a section view taken along the line 2—2 in FIG. 4. A threaded coupling adapter 8 is installed in a valve body 10, and sealed by means of an O-ring 9. The particular adapter shown fits a standard SCUBA regulator hose. The valve body can be configured with a screw-in adapter that has a standard quick connect fitting or any of various other fittings to adapt it to different sources of low pressure air supplies, as is known to those skilled in the art.

Figure 3:
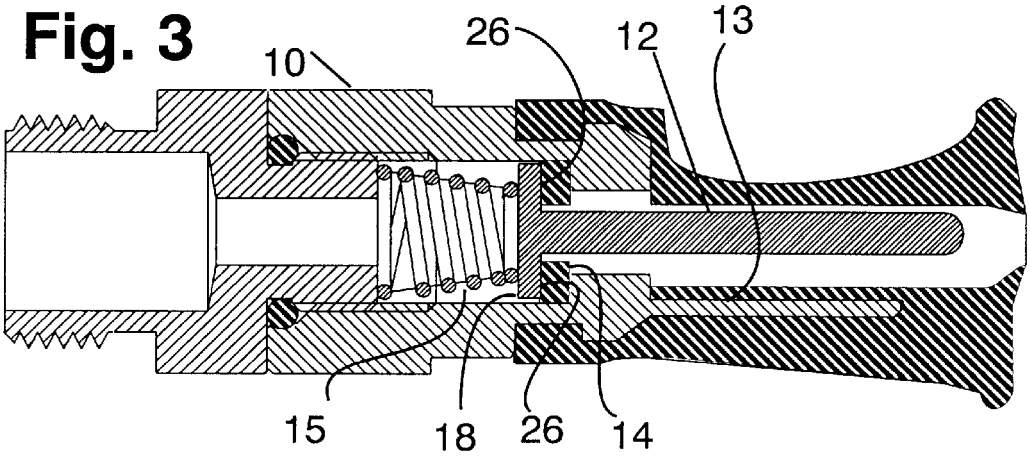
FIG. 3 section view taken along the line 3—3 in FIG. 7, with the valve in a closed position.

The valve body 10 has a valve opening 22 at the mouthpiece end. An axially inwardly directed surface forms a valve seat 23 for receiving an annular seal 14. The seal is made from any suitable rubber or elastomeric material. A disk-shaped valve 18 has a surface 26 for sealably engaging the seal 14. Gas pressure in the hose urges the valve 18 into a sealing engagement with the seal 14. Advantageously, a coil spring 15 can also be provided, disposed and compressed between an inner annular surface 28 of the coupling adapter 8 and the valve 18 for urging the valve into the sealing engagement absent the air pressure. The action of the spring helps keep dirt and other contaminants from passing through or interfering with proper operation of the valve when the valve body is disconnected or no gas pressure is present in the hose. The valve 18 is opened by a valve actuator, for example a valve stem 12 projecting through the valve opening 22 and substantially through a passage 11 in the mouthpiece 7. The valve stem 12 is substantially axially aligned in the passages 22 and 11 when the valve 18 is in a closed or sealing position, as shown in FIGS. 2, 3 and 5.

The valve body is advantageously provided with a substantially rigid member 13 projecting from the mouthpiece end into the mouthpiece 7, substantially parallel to and offset from the valve stem 12 when the valve stem is in the substantially axial alignment. As explained more fully in connection with FIG. 6, the member 13 prevents the valve stem 12 from translating off axis responsive to the exerted pressure. As a result, the valve stem reliably tilts off axis responsive to said exerted pressure.

Figure 8:
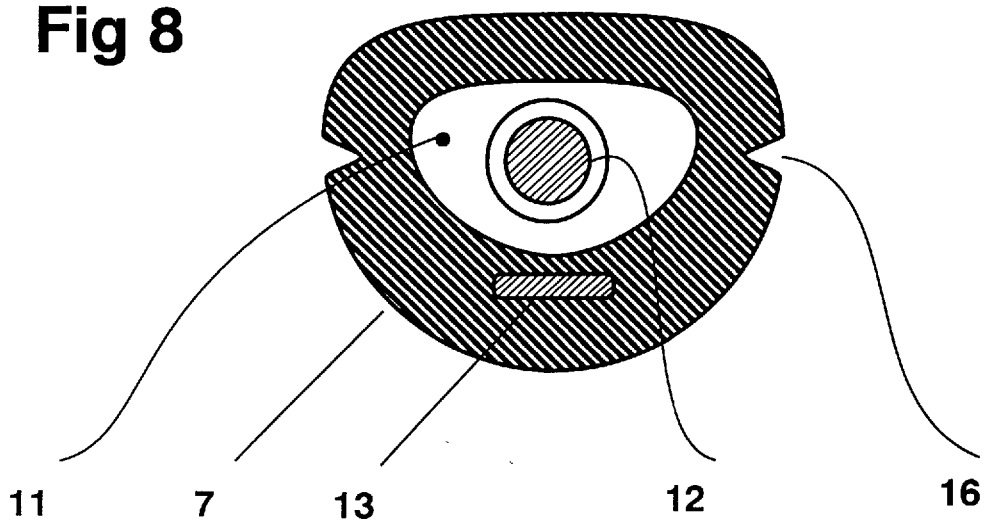
FIG. 8 is a section, in enlarged scale, taken along the line 8—8 in FIG. 7.
Figure 9:
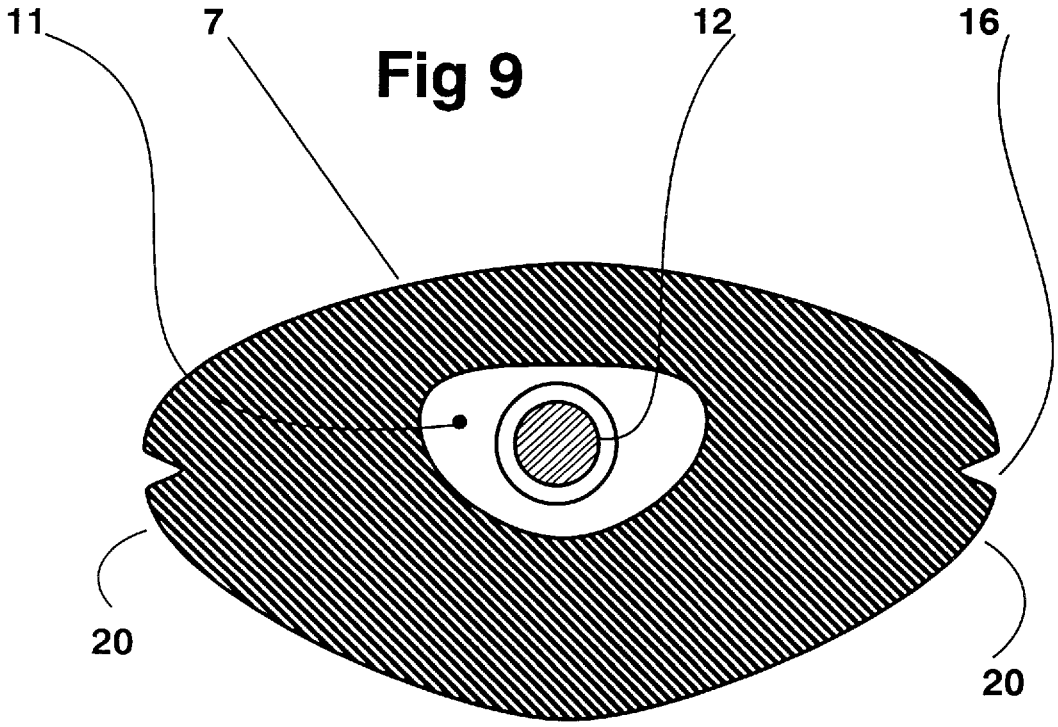
FIG. 9 is a section, in enlarged scale, taken along the line 9—9 in FIG. 7.

The mouthpiece 7 has a substantially oval cross section with a major axis and a minor axis, as shown in FIGS. 8 and 9. The mouthpiece has sides at opposite ends of the major axis and a top and a bottom respectively at opposite sides of the minor axis.

The mouthpiece 7 has an enlarged end 19 that allows a diver to hold the mouthpiece comfortably in the diver's mouth without using hands. The wide sides 20 of the end 19 restrict the position of the mouthpiece in the diver's mouth so that the diver can activate the valve by pressure with the lips and/or the teeth in a biting motion, as shown by arrows 21 in FIG. 6. The mouthpiece can be made of silicon rubber, neoprene or any similar resilient material that is robust and resistant to environmental degradation.

The breathing device is operable irrespective of whether mouthpiece 7 is in the mouth upside down or right side up. The axial passage 11 that runs through the mouthpiece is wider and deeper than the valve stem 12 and shaped to allow air to freely pass when the mouthpiece 7 is compressed by the mouth. The mouthpiece stiffener 13 can an integral extension of the valve body 10, extending beneath the valve stem, as shown in FIGS. 3, 6 and 7. Alternatively, the member 13 may be a separate member 13*a* which is pressed into a recess 30 as shown in FIG. 5. This fit need not be a force fit, as the mouthpiece can hold the member 13*a* in place. The member 13*a* can be inserted before the mouthpiece is attached, or alternatively, the member 13*a* can be inserted first into the mouthpiece, or even molded into the mouthpiece.

With reference to FIG. 3, the spring 15 holds the valve closed when there is no pressure in the system, sealing out contaminants and ensuring that the stem 12 will be correctly positioned when the breathable gas pressure is turned on.

FIGS. 4, 8 and 9 shows a pressure release grooves 16 running longitudinally the length of each side of the mouthpiece 7. The pressure release grooves 16 prevent the mouth from making a tight seal around the mouthpiece 7 and allows water and or air to pass out of the mouth when pressure in the mouth is greater than ambient pressure. These grooves can also be located in other circumferential positions around the outer surface of the mouthpiece.

A recessed annular groove 17, shown in FIGS. 2, 3, 5 and 7 is adapted for receiving a mating end 31 of the mouthpiece, which can be sealed thereto.

FIGS. 3 and 5 show the valve in a closed position, as it would be with air pressure in the valve. The valve stem 12 is in a resting position near the top of the air channel 11. The channel is larger than the valve stem so that air will freely pass the stem and flow through the channel and out the downstream end of the mouthpiece even when the channel is deformed by pressure from the outside of the mouthpiece. The thickness of the upper half of the mouthpiece 7 is significantly less than that of the lower half. In this position no air can pass through the valve.

FIG. 7 shows the valve in an open position. The valve stem 12 is tilted out of the substantially axial orientation when the top of the mouthpiece is depressed by pressure from the mouth or fingers of the diver. It does not matter whether the pressure on the top of the mouthpiece is exerted by the top or the bottom of the diver's mouth. The relatively thinner upper half 32 of the mouthpiece 7, easily compresses, allowing the valve stem 12 to be deflected downward into the open space of the air channel when pressure is applied, while the thicker bottom half of the mouthpiece is comparatively rigid and resists such deflection. The purpose of the mouthpiece stiffener 13 is to provide increased rigidity to the lower half of the mouthpiece 7. This increased rigidity can be provided by various other means. When the stem 12 is deflected downward, it forces the valve element 18 to tilt away from the seal 14, allowing air to flow past the seal, and down the air channel 11 along the sides of the valve stem 12, out the downstream end of the mouthpiece. The spring 15 is also further compressed when the valve 18 is pressed away from the seal 14. When the diver releases the pressure on the mouthpiece, the mouthpiece returns to its normal shape allowing the air pressure in the hose and spring biasing to push the valve stem back to the closed position, cutting off the flow of the breathable gas, for example air.

FIG. 8 the general streamlined appearance of the invention as it is attached to the low pressure hose 4. The emergency underwater breathing device is only negligibly larger than the hose itself, allowing it to be passed to a diver in need through a very small aperture.

FIG. 8 is a section view of the mouthpiece as taken across line 8—8 in FIG. 7. The shape of the air channel 11, through which the valve stem 12 passes, is only one of many possible variations in shape that can be used to accomplish this purpose. The thin wall of the body of the mouthpiece 7, above the air channel will compress easily under pressure while the lower part will not easily compress because the bottom of the mouthpiece is thicker and less flexible. In addition, the embedded stiffener 13, shown in this embodiment, makes the bottom of the mouthpiece completely rigid. As the mouthpiece is pressed from top and bottom, the top of the mouthpiece collapses, forcing the valve stem down into the lower area of the air channel, opening the valve, and allowing the air to pass through all the open area in the air channel.

FIG. 9 is a cross section view of the mouthpiece as taken across line 9—9 in FIG. 7. This is the enlarged downstream end which is placed behind the teeth and lips of the diver. The larger size of the mouthpiece 7 at this end can be compared to the cross section of the mouthpiece in FIG. 8.

What is claimed:

1. An emergency breathing device, comprising:

a resilient mouthpiece;

a valve body having a through passage connecting opposite ends of said valve body respectively adapted for receiving a hose coupling and said mouthpiece, said valve body having a valve opening adjacent said mouthpiece end;

a resilient seal seated on an axially interior side of said valve opening;

a valve having a seal engaging surface, gas pressure in said hose urging said valve into a sealing engagement with said seal; and, a valve actuator disposed in said mouthpiece and engaging said valve, whereby inward squeezing pressure from opposite sides exerted on said valve actuator through said mouthpiece opens said sealing engagement, allowing a breathable gas to flow from said hose into said mouthpiece, and termination of said inward squeezing pressure enables said gas pressure to close said sealing engagement and stop said flow of said breathable gas.

2. The device of claim 1, wherein said valve actuator comprises a valve stem extending from said valve, through said valve opening and substantially through said mouthpiece said valve stem being substantially axially aligned in said valve opening and in said mouthpiece during said sealing engagement.

3. The device of claim 2, wherein said valve body further comprises a substantially rigid member projecting from said mouthpiece end of said valve body into said mouth piece, substantially parallel to and offset from said valve stem when said valve stem is in said substantially axial alignment, whereby said valve stem resists translating off axis responsive to said exerted pressure, and instead reliably tilts off axis responsive to said exerted pressure.

4. The device of claim 3, wherein said substantially rigid member is embedded in a wall of said mouthpiece.

5. The device of claim 2, wherein said mouthpiece has a substantially oval cross section with a major axis and a minor axis, said mouthpiece having sides at opposite ends of said major axis and a top and a bottom respectively at opposite sides of said minor axis.

6. The device of claim 5, wherein said valve actuator reliably opens said valve responsive to said exerted pressure when said mouthpiece is oriented right side up in a mouth and when said mouthpiece is oriented upside down in said mouth.

7. The device of claim 1, further comprising resilient means for urging said valve into said sealing engagement with said valve seat absent said air pressure in said hose, said valve stem being substantially axially aligned in said valve opening and in said mouthpiece during said sealing engagement.

8. The device of claim 1, wherein said valve body and said mouthpiece are not substantially larger in any outer diameter than said hose.

9. The device of claim 1, wherein said mouthpiece comprises at least one longitudinal channel for safely venting excess gas pressure and water from a mouth in which said device is inserted.

10. The device of claim 1, comprising means in said mouthpiece for controlling deformation of said mouthpiece to ensure reliable opening of said sealing engagement when said pressure is exerted equally on said valve actuator through said mouthpiece from opposite directions.

11. The device of claim 10, wherein said deformation controlling means is embedded in a wall of said mouthpiece.

12. The device of claim 10, wherein said deformation controlling means rigidly projects from said valve body.

13. The device of claim 1, wherein said valve actuator is adapted to open said sealing engagement responsive to a biting down action of a diver breathing through said mouthpiece.

14. A SCUBA gear assembly, comprising:

a tank for a compressed breathable gas;

an octopus regulator for supplying said breathable gas from said tank;

a first hose connected to said octopus regulator;

a first secondary stage regulator and mouthpiece connected to said octopus regulator by said first hose;

a second hose connected to said octopus regulator;

a second secondary stage regulator and mouthpiece adapted for emergency breathing;

a valve body in said second secondary stage regulator having a through passage between opposite ends thereof, said valve body having at one of said ends a hose coupling connected to said second hose and having said mouthpiece at the other of said ends;

a resilient seal seated on an axially interior side of said valve opening;

a valve having a seal engaging surface, gas pressure in said hose urging said valve into a sealing engagement with said seal; and, a valve actuator disposed in said mouthpiece and engaging said valve, whereby inward squeezing pressure from opposite sides exerted on said valve actuator through said mouthpiece opens said sealing engagement, allowing a breathable gas to flow from said hose into said mouthpiece, and termination of said inward squeezing pressure enables said gas pressure to close said sealing engagement and stop said flow of said breathable gas.

15. The assembly of claim 14, comprising means in said mouthpiece for controlling deformation of said mouthpiece to ensure reliable opening of said sealing engagement when said pressure is exerted equally on said valve actuator through said mouthpiece from opposite directions.

16. The assembly of claim 14, wherein said mouthpiece has a substantially oval cross section with a major axis and a minor axis, said mouthpiece having sides at opposite ends of said major axis and a top and a bottom respectively at opposite sides of said minor axis.

17. The assembly of claim 16, wherein said valve actuator reliably opens said valve responsive to said exerted pressure when said mouthpiece is oriented right side up in a mouth and when said mouthpiece is oriented upside down in said mouth.

18. The assembly of claim 17, wherein said valve body and said mouthpiece are not substantially larger in any outer diameter than said second hose, whereby emergency breathing can be provided through small openings.

19. The assembly of claim 14, further comprising resilient means for urging said valve into a sealing engagement with said valve absent said gas pressure.

20. The assembly of claim 14, wherein said mouthpiece comprises at least one longitudinal channel for safely venting excess gas pressure and water from a mouth in which said mouthpiece is inserted.

21. The device of claim 14, wherein said valve actuator is adapted to open said sealing engagement responsive to a biting down action of a diver breathing through said mouthpiece.

* * * * *